US007378673B2

(12) United States Patent
Bykanov et al.

(10) Patent No.: US 7,378,673 B2
(45) Date of Patent: May 27, 2008

(54) SOURCE MATERIAL DISPENSER FOR EUV LIGHT SOURCE

(75) Inventors: Alexander N. Bykanov, San Diego, CA (US); Oleh Khodykin, San Diego, CA (US)

(73) Assignee: Cymer, Inc., San Diego, CA (US)

( * ) Notice: Subject to any disclaimer, the term of this patent is extended or adjusted under 35 U.S.C. 154(b) by 107 days.

(21) Appl. No.: 11/358,983

(22) Filed: Feb. 21, 2006

(65) Prior Publication Data

US 2006/0192153 A1 Aug. 31, 2006

Related U.S. Application Data

(63) Continuation-in-part of application No. 11/174,443, filed on Jun. 29, 2005, which is a continuation-in-part of application No. 11/067,124, filed on Feb. 25, 2005.

(51) Int. Cl.
*H01J 35/20* (2006.01)

(52) U.S. Cl. ..... 250/503.1; 250/504 R; 250/493.1

(58) Field of Classification Search ..... 250/504 R, 250/493.1, 503.1; 378/119, 143
See application file for complete search history.

(56) References Cited

U.S. PATENT DOCUMENTS

| | | | | |
|---|---|---|---|---|
| 2,759,106 | A | 8/1956 | Wolter | 250/53 |
| 3,150,483 | A | 9/1964 | Mayfield et al. | 60/35.5 |
| 3,232,046 | A | 2/1966 | Meyer | 50/35.5 |
| 3,279,176 | A | 10/1966 | Boden | 60/202 |
| 3,746,870 | A | 7/1973 | Demarest | 250/227 |
| 3,960,473 | A | 6/1976 | Harris | 425/467 |
| 3,961,197 | A | 6/1976 | Dawson | 250/493 |
| 3,969,628 | A | 7/1976 | Roberts et al. | 250/402 |
| 4,042,848 | A | 8/1977 | Lee | 313/231.6 |

(Continued)

FOREIGN PATENT DOCUMENTS

JP 02-105478 4/1990

(Continued)

OTHER PUBLICATIONS

U.S. Appl. No. 11/358,992, filed Feb. 21, 2006, Ershov et al.

(Continued)

*Primary Examiner*—Kiet T. Nguyen
(74) *Attorney, Agent, or Firm*—Matthew K. Hillman

(57) ABSTRACT

A source material dispenser for an EUV light source is disclosed that comprises a source material reservoir, e.g. tube, that has a wall and is formed with an orifice. The dispenser may comprise an electro-actuatable element, e.g. PZT material, that is spaced from the wall and operable to deform the wall and modulate a release of source material from the dispenser. A heat source heating a source material in the reservoir may be provided. Also, the dispenser may comprise an insulator reducing the flow of heat from the heat source to the electro-actuatable element. A method of dispensing a source material for an EUV light source is also described. In one method, a first signal may be provided to actuate the electro-actuatable elements to modulate a release of source material and a second signal, different from the first, may be provided to actuate the electro-actuatable elements to unclog the orifice.

20 Claims, 3 Drawing Sheets

U.S. PATENT DOCUMENTS

| | | | | |
|---|---|---|---|---|
| 4,088,966 | A | 5/1978 | Samis | 313/231.5 |
| 4,143,275 | A | 3/1979 | Mallozzi et al. | 250/503 |
| 4,162,160 | A | 7/1979 | Witter | 75/246 |
| 4,203,393 | A | 5/1980 | Giardini | 123/30 |
| 4,223,279 | A | 9/1980 | Bradford, Jr. et al. | 331/94.5 |
| 4,364,342 | A | 12/1982 | Asik | 123/143 |
| 4,369,758 | A | 1/1983 | Endo | 123/620 |
| 4,455,658 | A | 6/1984 | Sutter et al. | 372/38 |
| 4,504,964 | A | 3/1985 | Cartz et al. | 378/119 |
| 4,507,588 | A | 3/1985 | Asmussen et al. | 315/39 |
| 4,534,035 | A | 8/1985 | Long | 372/85 |
| 4,536,884 | A | 8/1985 | Weiss et al. | 378/119 |
| 4,538,291 | A | 8/1985 | Iwamatsu | 378/119 |
| 4,550,408 | A | 10/1985 | Karning et al. | 372/58 |
| 4,561,406 | A | 12/1985 | Ward | 123/536 |
| 4,596,030 | A | 6/1986 | Herziger et al. | 378/119 |
| 4,618,971 | A | 10/1986 | Weiss et al. | 378/34 |
| 4,626,193 | A | 12/1986 | Gann | 431/71 |
| 4,633,492 | A | 12/1986 | Weiss et al. | 378/119 |
| 4,635,282 | A | 1/1987 | Okada et al. | 378/34 |
| 4,751,723 | A | 6/1988 | Gupta et al. | 378/119 |
| 4,752,946 | A | 6/1988 | Gupta et al. | 378/119 |
| 4,774,914 | A | 10/1988 | Ward | 123/162 |
| 4,837,794 | A | 6/1989 | Riordan et al. | 378/119 |
| 4,891,820 | A | 1/1990 | Rando et al. | 372/93 |
| 4,928,020 | A | 5/1990 | Birx et al. | 307/106 |
| 4,959,840 | A | 9/1990 | Akins et al. | 372/57 |
| 5,005,180 | A | 4/1991 | Edelman et al. | 372/57 |
| 5,023,884 | A | 6/1991 | Akins et al. | 372/57 |
| 5,023,897 | A | 6/1991 | Neff et al. | 378/122 |
| 5,025,445 | A | 6/1991 | Anderson et al. | 372/20 |
| 5,025,446 | A | 6/1991 | Kuizenga | 372/21 |
| 5,027,076 | A | 6/1991 | Horsley et al. | 324/674 |
| 5,070,513 | A | 12/1991 | Letardi | 372/83 |
| 5,102,776 | A | 4/1992 | Hammer et al. | 430/311 |
| 5,126,638 | A | 6/1992 | Dethlefsen | 315/326 |
| 5,142,166 | A | 8/1992 | Birx | 307/419 |
| 5,171,360 | A | 12/1992 | Orme et al. | 75/331 |
| 5,175,755 | A | 12/1992 | Kumakhov | 378/34 |
| 5,189,678 | A | 2/1993 | Ball et al. | 372/28 |
| 5,226,948 | A | 7/1993 | Orme et al. | 75/331 |
| 5,259,593 | A | 11/1993 | Orme et al. | 266/78 |
| 5,313,481 | A | 5/1994 | Cook et al. | 372/37 |
| 5,315,611 | A | 5/1994 | Ball et al. | 372/56 |
| 5,319,695 | A | 6/1994 | Itoh et al. | 378/84 |
| 5,340,090 | A | 8/1994 | Orme et al. | 266/202 |
| 5,359,620 | A | 10/1994 | Akins | 372/58 |
| RE34,806 | E | 12/1994 | Cann | 427/446 |
| 5,411,224 | A | 5/1995 | Dearman et al. | 244/53 |
| 5,448,580 | A | 9/1995 | Birx et al. | 372/38 |
| 5,471,965 | A | 12/1995 | Kapich | 123/565 |
| 5,504,795 | A | 4/1996 | McGeoch | 378/119 |
| 5,729,562 | A | 3/1998 | Birx et al. | 372/38 |
| 5,763,930 | A | 6/1998 | Partlo | 250/504 |
| 5,852,621 | A | 12/1998 | Sandstrom | 372/25 |
| 5,856,991 | A | 1/1999 | Ershov | 372/57 |
| 5,863,017 | A | 1/1999 | Larson et al. | 248/176.1 |
| 5,866,871 | A | 2/1999 | Birx | 219/121 |
| 5,894,980 | A | 4/1999 | Orme-Marmarelis et al. | 228/33 |
| 5,894,985 | A | 4/1999 | Orme-Marmarelis et al. | 228/262 |
| 5,936,988 | A | 8/1999 | Partlo et al. | 372/38 |
| 5,938,102 | A | 8/1999 | Muntz et al. | 228/102 |
| 5,953,360 | A | 9/1999 | Vitruk et al. | 372/87 |
| 5,963,616 | A | 10/1999 | Silfvast et al. | 378/122 |
| 5,970,076 | A | 10/1999 | Hamada | 372/20 |
| 5,978,394 | A | 11/1999 | Newman et al. | 372/32 |
| 5,991,324 | A | 11/1999 | Knowles et al. | 372/57 |
| 6,005,879 | A | 12/1999 | Sandstrom et al. | 372/25 |
| 6,016,325 | A | 1/2000 | Ness et al. | 372/38 |
| 6,018,537 | A | 1/2000 | Hofmann et al. | 372/25 |
| 6,028,880 | A | 2/2000 | Carlesi et al. | 372/58 |
| 6,031,241 | A | 2/2000 | Silfvast et al. | 250/504 |
| 6,031,598 | A | 2/2000 | Tichenor et al. | 355/67 |
| 6,039,850 | A | 3/2000 | Schulz | 204/192.15 |
| 6,051,841 | A | 4/2000 | Partlo | 250/504 |
| 6,064,072 | A | 5/2000 | Partlo et al. | 250/504 |
| 6,067,311 | A | 5/2000 | Morton et al. | 372/57 |
| 6,094,448 | A | 7/2000 | Fomenkov et al. | 372/102 |
| 6,104,735 | A | 8/2000 | Webb | 372/37 |
| 6,128,323 | A | 10/2000 | Myers et al. | 372/38.1 |
| 6,151,346 | A | 11/2000 | Partlo et al. | 372/38 |
| 6,151,349 | A | 11/2000 | Gong et al. | 372/58 |
| 6,164,116 | A | 12/2000 | Rice et al. | 73/1.72 |
| 6,172,324 | B1 | 1/2001 | Birx | 219/121.57 |
| 6,186,192 | B1 | 2/2001 | Orme-Marmarelis et al. | 141/18 |
| 6,192,064 | B1 | 2/2001 | Algots et al. | 372/99 |
| 6,195,272 | B1 | 2/2001 | Pascente | 363/21 |
| 6,208,674 | B1 | 3/2001 | Webb et al. | 372/57 |
| 6,208,675 | B1 | 3/2001 | Webb | 372/58 |
| 6,219,368 | B1 | 4/2001 | Govorkov | 372/59 |
| 6,224,180 | B1 | 5/2001 | Pham-Van-Diep et al. | 347/2 |
| 6,228,512 | B1 | 5/2001 | Bajt et al. | 428/635 |
| 6,232,129 | B1 * | 5/2001 | Wiktor | 436/180 |
| 6,240,117 | B1 | 5/2001 | Gong et al. | 372/58 |
| 6,264,090 | B1 | 7/2001 | Muntz et al. | 228/33 |
| 6,276,589 | B1 | 8/2001 | Watts, Jr. et al. | 228/33 |
| 6,285,743 | B1 | 9/2001 | Kondo et al. | 378/119 |
| 6,304,630 | B1 | 10/2001 | Bisschops et al. | 378/119 |
| 6,307,913 | B1 | 10/2001 | Foster et al. | 378/34 |
| 6,317,448 | B1 | 11/2001 | Das et al. | 372/32 |
| 6,359,922 | B1 | 3/2002 | Partlo et al. | 372/58 |
| 6,370,174 | B1 | 4/2002 | Onkels et al. | 372/38.04 |
| 6,377,651 | B1 | 4/2002 | Richardson et al. | 378/34 |
| 6,381,257 | B1 | 4/2002 | Ershov et al. | 372/57 |
| 6,392,743 | B1 | 5/2002 | Zambon et al. | 355/69 |
| 6,396,900 | B1 | 5/2002 | Barbee, Jr. et al. | 378/84 |
| 6,404,784 | B2 | 6/2002 | Komine | 372/9 |
| 6,414,979 | B2 | 7/2002 | Ujazdowski et al. | 372/87 |
| 6,442,181 | B1 | 8/2002 | Oliver et al. | 372/25 |
| 6,449,086 | B1 | 9/2002 | Singh | 359/361 |
| 6,452,194 | B2 | 9/2002 | Bijkerk et al. | 250/492.2 |
| 6,452,199 | B1 | 9/2002 | Partlo et al. | 250/504 |
| 6,466,602 | B1 | 10/2002 | Fleurov et al. | 372/87 |
| 6,477,193 | B2 | 11/2002 | Oliver et al. | 372/58 |
| 6,491,737 | B2 | 12/2002 | Orme-Marmerelis et al. | 75/335 |
| 6,493,374 | B1 | 12/2002 | Fomenkov et al. | 372/102 |
| 6,493,423 | B1 | 12/2002 | Bisschops | 378/119 |
| 6,520,402 | B2 | 2/2003 | Orme-Marmerelis et al. | 228/260 |
| 6,529,531 | B1 | 3/2003 | Everage et al. | 372/20 |
| 6,532,247 | B2 | 3/2003 | Spangler et al. | 372/61 |
| 6,535,531 | B1 | 3/2003 | Smith et al. | 372/25 |
| 6,538,737 | B2 | 3/2003 | Sandstrom et al. | 356/334 |
| 6,549,551 | B2 | 4/2003 | Ness et al. | 372/38.07 |
| 6,562,099 | B2 | 5/2003 | Orme-Marmerelis et al. | 75/335 |
| 6,566,667 | B1 | 5/2003 | Partlo et al. | 250/504 |
| 6,566,668 | B2 | 5/2003 | Rauch et al. | 250/504 |
| 6,567,450 | B2 | 5/2003 | Myers et al. | 372/55 |
| 6,567,499 | B2 | 5/2003 | McGeoch | 378/119 |
| 6,576,912 | B2 | 6/2003 | Visser et al. | 250/492.2 |
| 6,580,517 | B2 | 6/2003 | Lokai et al. | 356/519 |
| 6,584,132 | B2 | 6/2003 | Morton | 372/57 |
| 6,586,757 | B2 | 7/2003 | Melnychuk et al. | 250/504 |
| 6,590,922 | B2 | 7/2003 | Onkels | 372/57 |
| 6,590,959 | B2 | 7/2003 | Kandaka et al. | 378/119 |
| 6,618,421 | B2 | 9/2003 | Das et al. | 372/55 |
| 6,621,846 | B1 | 9/2003 | Sandstrom et al. | 372/57 |
| 6,625,191 | B2 | 9/2003 | Knowles et al. | 372/55 |
| 6,647,086 | B2 | 11/2003 | Amemiya et al. | 378/34 |
| 6,656,575 | B2 | 12/2003 | Bijkerk et al. | 428/212 |
| 6,671,294 | B2 | 12/2003 | Kroyan et al. | 372/20 |
| 6,714,624 | B2 | 3/2004 | Fornaciari et al. | 378/119 |
| 6,721,340 | B1 | 4/2004 | Fomenkov et al. | 372/25 |

| | | | | |
|---|---|---|---|---|
| 6,724,462 | B1 | 4/2004 | Singh et al. | 355/53 |
| 6,738,452 | B2 * | 5/2004 | McGregor et al. | 378/119 |
| 6,744,060 | B2 | 6/2004 | Ness et al. | 315/111.01 |
| 6,757,316 | B2 | 6/2004 | Newman et al. | 372/57 |
| 6,780,496 | B2 | 8/2004 | Bajt et al. | 425/216 |
| 6,782,031 | B1 | 8/2004 | Hofmann et al. | 372/90 |
| 6,795,474 | B2 | 9/2004 | Partlo et al. | 372/57 |
| 6,804,327 | B2 | 10/2004 | Schriever et al. | 378/119 |
| 6,815,700 | B2 | 11/2004 | Melnychuk et al. | 250/504 |
| 6,822,251 | B1 | 11/2004 | Arenberg et al. | 250/504 |
| 6,865,255 | B2 | 3/2005 | Richardson | 378/119 |
| 7,122,816 | B2 * | 10/2006 | Algots et al. | 250/504 R |
| 2001/0006217 | A1 | 7/2001 | Bisschops | 250/493.1 |
| 2001/0055364 | A1 | 12/2001 | Kandaka et al. | 379/119 |
| 2002/0009176 | A1 | 1/2002 | Ameniya et al. | 378/34 |
| 2002/0048288 | A1 | 4/2002 | Kroyan et al. | 372/20 |
| 2002/0100882 | A1 | 8/2002 | Schriever et al. | 250/504 |
| 2002/0141536 | A1 | 10/2002 | Richardson | 378/119 |
| 2002/0168049 | A1 | 11/2002 | Schriever et al. | 378/119 |
| 2003/0068012 | A1 | 4/2003 | Ahmad et al. | 378/119 |
| 2003/0196512 | A1 | 10/2003 | Wyszomierski et al. | 75/336 |
| 2003/0219056 | A1 | 11/2003 | Yager et al. | 372/57 |
| 2004/0047385 | A1 | 3/2004 | Knowles et al. | 372/55 |

FOREIGN PATENT DOCUMENTS

| | | |
|---|---|---|
| JP | 03-173189 | 7/1991 |
| JP | 06-053594 | 2/1994 |
| JP | 09-219555 | 8/1997 |
| JP | 2000-058944 | 2/2000 |
| JP | 2000091096 A | 3/2000 |
| WO | WO2004/104707 | 12/2004 |

OTHER PUBLICATIONS

U.S. Appl. No. 11/358,988, filed Feb. 21, 2006, Bykanov et al.
U.S. Appl. No. 60/775,442, filed Feb. 21, 2006, Bowering et al.
Andreev, et al., "Enhancement of laser/EUV conversion by shaped laser pulse interacting with Li-contained targets for EUV lithography", *Proc. of SPIE*, 5196:128-136, (2004).
Apruzese, J.P., "X-Ray Laser Research Using Z Pinches," *Am. Inst. of Phys*. 399-403, (1994).
Bal et al., "Optimizing multilayer coatings for Extreme UV projection systems," Faculty of Applied Sciences, Delft University of Technology.
Bollanti, et al., "Compact Three Electrodes Excimer Laser IANUS for a POPA Optical System," *SPIE Proc*. (2206)144-153, (1994).
Bollanti, et al., "Ianus, the three-electrode excimer laser," *App. Phys. B* (*Lasers & Optics*) 66(4):401-406, (1998).
Braun, et al., "Multi-component EUV Multilayer Mirrors," *Proc. SPIE*, 5037:2-13, (2003).
Choi, et al., "A $10^{13}$ A/s High Energy Density Micro Discharge Radiation Source," *B. Radiation Characteristics*, p. 287-290.
Choi, et al., "Fast pulsed hollow.cathode capillary discharge device," *Rev. of Sci. Instrum*. 69(9):3118-3122 (1998).
Choi et al., Temporal development of hard and soft x-ray emission from a gas-puff Z pinch, *Rev. Sci. Instrum*.57(8), pp. 2162-2164 (Aug. 1986).
Coutts et al., "High average power blue generation from a copper vapour laser pumped titanium sapphire laser", Journal of Modern Optics, vol. 45, No. 6, p. 1185-1197 (1998).
Eckhardt, et al., "Influence of doping on the bulk diffusion of Li into Si(100)," *Surface Science* 319 (1994) 219-223.
Eichler, et al., "Phase conjugation for realizing lasers with diffraction limited beam quality and high average power," Techninische Universitat Berlin, Optisches Institut, (Jun. 1998).
Fedosejevs et al., "Subnanosecond pulses from a KrF Laser pumped $SF_6$ Brillouin Amplifier", *IEEE J. QE* 21, 1558-1562 (1985).
Feigl, et al., "Heat Resistance of EUV Multilayer Mirrors for Long-time Applications," *Microelectric Engineering*, 57-58:3-8, (2001).
Fomenkov, et al., "Characterization of a 13.5nm Source for EUV Lithography based on a Dense Plasma Focus and Lithium Emission," Sematech Intl. Workshop on EUV Lithography (Oct. 1999).
Giordano et al., "Magnetic pulse compressor for prepulse discharge in spiker-sustainer excitati technique for XeC1 lasers," *Rev. Sci. Instrum* 65(8), pp. 2475-2481 (Aug. 1994).
Hansson, et al., "Xenon liquid jet laser-plasma source for EUV lithography," Emerging Lithographic Technologies IV, *Proc. of SPIE*, vol. 3997:729-732 (2000).
Hercher, "Tunable single mode operation of gas lasers using intracavity tilted etalons," Applied Optics, vol. 8, No. 6, Jun. 1969, pp. 1103-1106.
Jahn, Physics of Electric Propulsion, McGraw-Hill Book Company, (Series in Missile and Space U.S.A.), Chap. 9, "Unsteady Electromagnetic Acceleration," p. 257 (1968).
Jiang, et al., "Compact multimode pumped erbium-doped phosphate fiber amplifiers," *Optical Engineering*, vol. 42, Issue 10, pp. 2817-2820 (Oct. 2003).
Kato, Yasuo, "Electrode Lifetimes in a Plasma Focus Soft X-Ray Source," *J. Appl. Phys*. (33) Pt. 1, No. 8:4742-4744 (1991).
Kato, et al., "Plasma focus x-ray source for lithography," *Am. Vac. Sci. Tech. B*., 6(1): 195-198 (1988).
Kjornrattanawanich, Ph.D. Dissertation, U.S. Department of Energy, Lawrence Livermore National Laboratory, Sep. 1, 2002.
Kloidt et al., "Enhancement of the reflectivity of Mo/Si multilayer x-ray mirrors by thermal treatment," *Appl. Phys. Lett*. 58(23), 2601-2603 (1991).
Kuwahara et al., "Short-pulse generation by saturated KrF laser amplification of a steep Stokes pulse produced by two-step stimulated Brillouin scattering", *J. Opt. Soc. Am*. B 17, 1943-1947 (2000).
Lange, Michael R., et al., "High gain coefficient phosphate glass fiber amplifier," NFOEC 2003, paper No. 126.
Lebert, et al., "Soft x-ray emission of laser-produced plasmas using a low-debris cryogenic nitrogen target," *J. App. Phys*., 84(6):3419-3421 (1998).
Lebert, et al., "A gas discharged based radiation source for EUV-lithography," Intl. Conf. Micro and Nano-Engineering 98 (Sep. 22-24, 1998) Leuven, Belgium.
Lebert, et al., "Investigation of pinch plasmas with plasma parameters promising ASE," Inst. Phys. Conf. Ser No. 125: Section 9, pp. 411-415 (1992) Schiersee, Germany.
Lebert, et al., "Comparison of laser produced and gas discharge based EUV sources for different applications," Intl. Conf. Micro- and Nano-Engineering 98 (Sep. 22-24, 1998) Leuven, Belgium.
Lee, Ja H., "Production of dense plasmas in hypocycloidal pinch apparatus," *The Phys. Of Fluids*, 20(2):313-321 (1977).
Lewis, Ciaran L.S., "Status of Collision-Pumped X-ray Lasers," *Am Inst. Phys*. pp. 9-16 (1994).
Lowe, "Gas plasmas yield X-rays for Lithography," *Electronics*, pp. 40-41 (Jan. 27, 1982).
Malmquist, et al., "Liquid-jet target for laser-plasma soft x-ray generation," *Am. Inst. Phys*. 67(12):4150-4153 (1996).
Maruyama et al., Characteristics of high-power excimer laser master oscillator power amplifier system for dye laser pumping, Optics Communications, vol. 87, No. 3 p. 105-108 (1992).
Mather, "Formation of a High-Density Deuterium Plasma Focus," *Physics of Fluids*, 8(2), 366-377 (Feb. 1965).
Mather, et al., "Stability of the Dense Plasma Focus," *Phys. Of Fluids*, 12(11):2343-2347 (1969).
Matthews and Cooper, "Plasma sources for x-ray lithography," *SPIE, vol. 333 Submicron Lithography*, pp. 136-139 (1982).
Mayo, et al., "A magnetized coaxial source facility for the generation of energetic plasma flows," *Sci. Technol*. vol. 4:pp. 47-55 (1994).
Mayo, et al., "Initial Results on high enthalpy plasma generation in a magnetized coaxial source," *Fusion Tech* vol. 26:1221-1225 (1994).
Mitsuyama, et al., "Compatibility of insulating ceramic materials with liquid breeders," *Fusion Eng. and Design* 39-40 (1998) 811-817.
Montcalm et al., "Mo/Y multilayer mirrors for the 8-12-nm wavelength region," *Optics Letters*, 19(15): 1173-1175 (Aug. 1, 1994).
Montcalm et al., "In situ reflectance measurements of soft-x-ray/extreme-ultraviolet Mo/Y multilayer mirrors," *Optics Letters* 20(12): 1450-1452 (Jun. 15, 1995).

Nilsen et al., "Mo:Y multilayer mirror technology utilized to image the near-field output of a Ni-like Sn laser at 11.9 nm," *Optics Letters*, 28(22) 2249-2251 (Nov. 15, 2003).
Nilsen, et al., "Analysis of resonantly photopumped Na-Ne x-ray-laser scheme," *Am Phys. Soc.* 44(7):4591-4597 (1991).
H. Nishioka et al., "UV saturable absorber for short-pulse KrF laser systems", *Opt. Lett.* 14, 692-694 (1989).
Orme, et al., "Electronics charging and deflection of nonconventional droplet streams formed from capillary stream breakup," *Physics of Fluids*, 12(9):2224-2235, (Sep. 2000).
Orme, et al., "Charged Molten Metal Droplet Deposition As a Direct Write Technology", MRS 2000 Spring Meeting, San Francisco, (Apr. 2000).
Pant, et al., "Behavior of expanding laser produced plasma in a magnetic field," *Physica Sripta*, T75:104-111, (1998).
Partlo, et al., "EUV (13.5nm) Light Generation Using a Dense Plasma Focus Device," *SPIE Proc. On Emerging Lithographic Technologies III*, vol. 3676, 846-858 (Mar. 1999).
Pearlman et al., "X-ray lithography using a pulsed plasma source," *J. Vac. Sci. Technol.*, pp. 1190-1193 (Nov./Dec. 1981).
Pint et al., "High temperature compatibility issues for fusion reactor structural materials," Metals and Ceramics Division, Oak Ridge National Laboratory, P.O. Box 2008, Oak Ridge, TN 37831-6156.
Porter, et al., "Demonstration of Population Inversion by Resonant Photopumping in a Neon Gas Cell Irradiated by a Sodium Z Pinch," *Phys. Rev. Let.*, 68(6):796-799, (Feb. 1992).
Price, Robert H., "X-Ray Microscopy using Grazing Incidence Reflectance Optics," *Am. Inst. Phys.* , pp. 189-199, (1981).
Qi, et al., "Fluorescence in Mg IX emission at 48.340 Å from Mg pinch plasmas photopumped by A1 XI line radiation at 48.338 Å," *The Am. Phys. Soc.*, 47(3):2253-2263 (Mar. 1993).
Sae-Lao et al., "Performance of normal-incidence molybdenum-yttrium multilayer-coated diffraction grating at a wavelength of 9 nm," *Applied Optics*, 41(13): 2394-2400 (May 1, 2002).
Sae-Lao et al., "Molybdenum-strontium multilayer mirrors for the 8-12-nm extreme-ultraviolet wavelength region," *Optics Letters*, 26(7):468-470, (Apr. 1, 2001).
Sae-Lao et al., "Normal-incidence multilayer mirrors for the 8-12 nm wavelength region," Information Science and Technology, Lawrence Livermore National Laboratory.
Sae-Lao et al., "Measurements of the refractive index of yttrium in the 50-1300-eV energy region," *Applied Optics*, 41(34):7309-7316 (Dec. 1, 2002).
Scheuer, et al., "A Magnetically-Nozzled, Quasi-Steady, Multimegawatt, Coaxial Plasma Thruster," *IEEE: Transactions on Plasma Science*, 22(6) (Dec. 1994).
S. Schiemann et al., "Efficient temporal compression of coherent nanosecond pulses in a compact SBS generator-amplifier setup", *IEEE J. QE* 33, 358-366 (1997).
Schriever, et al., "Laser-produced lithium plasma as a narrow-band extended ultraviolet radiation source for photoelectron spectroscopy," *App. Optics*, 37(7):1243-1248, (Mar. 1998).
Schriever, et al., "Narrowband laser produced extreme ultraviolet sources adapted to silicon/molybdenum multilayer optics," *J. of App. Phys.*, 83(9):4566-4571, (May 1998).
Sharafat et al., Coolant Structural Materials Compatibility, Joint APEX Electronic Meeting, UCLA, (Mar. 24, 2000).
Shiloh et al., "Z Pinch of a Gas Jet," *Physical Review Lett.*, 40(8), pp. 515-518 (Feb. 20, 1978).
Silfvast, et al., "High-power plasma discharge source at 13.5 nm and 11.4 nm for EUV lithography," *SPIE*, vol. 3676:272-275, (Mar. 1999).
Silfvast, et al., "Lithium hydride capillary discharge creates x-ray plasma at 13.5 nanometers," *Laser Focus World*, p. 13. (Mar. 1997).
Singh et al., "Improved Theoretical Reflectivities of Extreme Ultraviolet Mirrors," Optics Research Group, Faculty of Applied Sciences, Delft University of Technology.
Singh et al., "Design of multilayer extreme-ultraviolet mirrors for enhanced reflectivity," *Applied Optics*, 39(13):2189-2197 (May 1, 2000).
Soufli, et al., "Absolute photoabsorption measurements of molybdenum in the range 60-930 eV for optical constant determination," *Applied Optics* 37(10): 1713-1719 (Apr. 1, 1998).
Srivastava et al., "High-temperature studies on Mo-Si multilayers using transmission electron microscope," *Current Science*, 83 (8):997-1000 (Oct. 25, 2002).
Stallings et al., "Imploding argon plasma experiments," *Appl. Phys. Lett.*, 35(7), pp. 524-526 (Oct. 1, 1979).
Tada et al., "1-pm spectrally narrowed compact ArF excimer laser for microlithography", *Laser and Electro-Optics*, CLEO '96, CThG4, p. 374 (1996).
Takahashi, E., et al., "KrF laser picosecond pulse source by stimulated scattering processes", *Opt. Commun.* 215, 163-167 (2003).
Takahashi, E., et al., "High-intensity short KrF laser-pulse generation by saturated amplification of truncated leading-edge pulse", *Opt. Commun.* 185, 431-437 (2000).
Takenaka, et al., "Heat resistance of Mo/Si, $MoSi_2$/Si, and $Mo_5Si_3$/Si multilayer soft x-ray mirrors," *J. Appl. Phys.* 78(9) 5227-5230 (Nov. 1, 1995).
Tillack, et al., "Magnetic Confinement of an Expanding Laser-Produced Plasma", UC San Diego, Center for Energy Research, UCSD Report & Abramova—Tornado Trap.
Wilhein, et al., "A slit grating spectrograph for quantitative soft x-ray spectroscopy," *Am. Inst. Of Phys. Rev. of Sci. Instrum.*, 70(3):1694-1699, (Mar. 1999).
Wu, et al., "The vacuum Spark and Spherical Pinch X-ray/EUV Point Sources," *SPIE. Conf. On Emerging Tech. III*, Santa Clara, CA, vol. 3676:410-420, (Mar. 1999).
Yusheng et al., "Recent progress of "Heaven-One" high power KrF excimer laser system", *Laser and Electro-Optics*, CLEO '96, CThG4, p. 374 (1996).
Zombeck, M.V., "Astrophysical Observations with High Resolution X-ray Telescope," *Am. Inst. Of Phys.*, pp. 200-209, (1981).

* cited by examiner

SOURCE MATERIAL DISPENSER FOR EUV LIGHT SOURCE

The present application is a continuation-in-part application of co-pending U.S. patent application Ser. No. 11/067,124 filed on Feb. 25, 2005, entitled METHOD AND APPARATUS FOR EUV PLASMA SOURCE TARGET DELIVERY, attorney docket number 2004-0008-01, the entire contents of which are hereby incorporated by reference herein.

The present application is also a continuation-in-part application of co-pending U.S. patent application Ser. No. 11/174,443 filed on Jun. 29, 2005, entitled LPP EUV PLASMA SOURCE MATERIAL TARGET DELIVERY SYSTEM, attorney docket number 2005-0003-01, the entire contents of which are hereby incorporated by reference herein.

The present application is also related to co-pending U.S. non-provisional patent application entitled LASER PRODUCED PLASMA EUV LIGHT SOURCE WITH PRE-PULSE filed concurrently herewith, Ser. No. 11/358988, the entire contents of which are hereby incorporated by reference herein.

The present application is also related to co-pending U.S. nonprovisional patent application entitled LASER PRODUCED PLASMA EUV LIGHT SOURCE filed concurrently herewith, Ser. No 11/358992, the entire contents of which are hereby incorporated by reference herein.

The present application is also related to co-pending U.S. provisional patent application entitled EXTREME ULTRAVIOLET LIGHT SOURCE filed concurrently herewith, Ser. No. 60/775442, the entire contents of which are hereby incorporated by reference herein.

FIELD OF THE INVENTION

The present invention relates to extreme ultraviolet ("EUV") light sources which provide EUV light from a plasma that is created from a source material and collected and directed to a focus for utilization outside of the EUV light source chamber, e.g., for semiconductor integrated circuit manufacturing photolithography e.g., at wavelengths of around 50 nm and below.

BACKGROUND OF THE INVENTION

Extreme ultraviolet ("EUV") light, e.g., electromagnetic radiation having wavelengths of around 50 nm or less (also sometimes referred to as soft x-rays), and including light at a wavelength of about 13.5 nm, can be used in photolithography processes to produce extremely small features in substrates, e.g., silicon wafers.

Methods to produce EUV light include, but are not necessarily limited to, converting a material into a plasma state that has an element, e.g., xenon, lithium or tin, with an emission line in the EUV range. In one such method, often termed laser produced plasma ("LPP") the required plasma can be produced by irradiating a target material, such as a droplet, stream or cluster of material having the required line-emitting element, with a laser beam. For example, for Sn and Li source materials, the source material may be heating above its respective melting point and held in a capillary tube formed with an orifice, e.g. nozzle, at one end. When a droplet is required, an electro-actuatable element, e.g. piezoelectric (PZT) material, may be used to squeeze the capillary tube and generate a droplet at or downstream of the nozzle. With this technique, a relatively uniform stream of droplets as small as about 20-30 μm can be obtained.

As used herein, the term "electro-actuatable element" and its derivatives, means a material or structure which undergoes a dimensional change when subjected to a voltage, electric field, magnetic field, or combinations thereof and includes but is not limited to piezoelectric materials, electrostrictive materials and magnetostrictive materials. Typically, electro-actuatable elements operate efficiently and dependably within and range of temperatures, with some PZT materials having a maximum operational temperature of about 250 degrees Celsius.

Once generated, the droplet may travel, e.g. under the influence of gravity or some other force, and within a vacuum chamber, to an irradiation site where the droplet is irradiated, e.g. by a laser beam. For this process, the plasma is typically produced in a sealed vessel, e.g., vacuum chamber, and monitored using various types of metrology equipment. In addition to generating EUV radiation, these plasma processes also typically generate undesirable by-products in the plasma chamber (e.g debris) which can potentially damage or reduce the operational efficiency of the various plasma chamber optical elements. This debris can include heat, high energy ions and scattered debris from the plasma formation, e.g., atoms and/or clumps/microdroplets of source material. For this reason, it is often desirable to use so-called "mass limited" droplets of source material to reduce or eliminate the formation of debris. The use of "mass limited" droplets also may result in a reduction in source material consumption.

Another factor that must be considered is nozzle clogging. This may be caused by several mechanisms, operating alone or in combination. These can include impurities, e.g. oxides and nitrides, in the molten source material, and/or freezing of the source material. Clogging can disturb the flow of source material through the nozzle, in some cases causing droplets to move along a path that is at an angle to the desired droplet trajectory. Manually accessing the nozzle for the purpose of unclogging it can be expensive, labor intensive and time-consuming. In particular, these systems typically require a rather complicated and time consuming purging and vacuum pump-down of the plasma chamber prior to a re-start after the plasma chamber has been opened. This lengthy process can adversely affect production schedules and decrease the overall efficiency of light sources for which it is typically desirable to operate with little or no downtime.

With the above in mind, Applicants disclose systems and methods for effectively delivering a stream of droplets to a selected location in an EUV light source.

SUMMARY OF THE INVENTION

In a first aspect, a source material dispenser for an EUV light source is disclosed that comprises a source material reservoir, e.g. tube, that has a wall and is formed with an orifice. The dispenser may further comprise an electro-actuatable element that is spaced from the wall and operable to deform the wall and modulate a release of source material from the dispenser. A heat source heating a source material in the reservoir may be provided. Also, the dispenser may comprise a heat insulator reducing the flow of heat from the heat source to the electro-actuatable element.

In a particular embodiment, the heat insulator, e.g. silica, may be disposed between the electro-actuatable element and the wall to transmit forces therebetween. In one implementation, the heat source may comprise a resistive material that may be interposed between the wall and the insulator, for example, the heat source may comprise a resistive material, e.g. Mo, that is coated on the wall of the reservoir. In one arrangement, a cooling system for cooling the electro-actuatable element may be provided.

In another aspect, a source material dispenser for an EUV light source is disclosed that comprises a source material reservoir having a wall and formed with an orifice, and a plurality of electro-actuatable elements. For this aspect, each element may be positioned to deform a different portion of the wall to modulate a release of source material from the dispenser. The dispenser may further comprise a plurality of heat insulators, with each insulator disposed between a respective the electro-actuatable element and the wall to transmit forces therebetween. A heat source comprising a resistive material may be interposed between the wall and the insulator(s).

In one embodiment, a clamp may be used to clamp the electro-actuatable elements on the reservoir. In one implementation, the dispenser may further comprise a controller for generating a first signal to actuate the electro-actuatable elements to modulate a release of source material from the reservoir and a second signal, different from the first signal, for unclogging the orifice.

A method of dispensing a source material for an EUV light source is also described. The method may comprise the acts/steps of: providing a source material reservoir having a wall and formed with an orifice; providing a plurality of electro-actuatable elements, each element positioned to deform a different portion of the wall; and actuating the elements to modulate a release of source material from the dispenser.

One particular method may also comprise the act/step of providing a plurality of heat insulators, each insulator disposed between a respective electro-actuatable element and the wall to transmit forces therebetween.

In one method, the act/step of providing a heat source, wherein the heat source comprising a resistive material interposed between the wall and the insulator(s), may be completed.

In one or more of the above described methods, a first drive signal may be provided to actuate the electro-actuatable elements to modulate a release of source material from the reservoir for plasma production and a second drive signal, different from the first drive signal, may be provided to actuate the electro-actuatable elements to unclog the orifice.

DETAILED DESCRIPTION OF PREFERRED EMBODIMENTS

Figure 1:
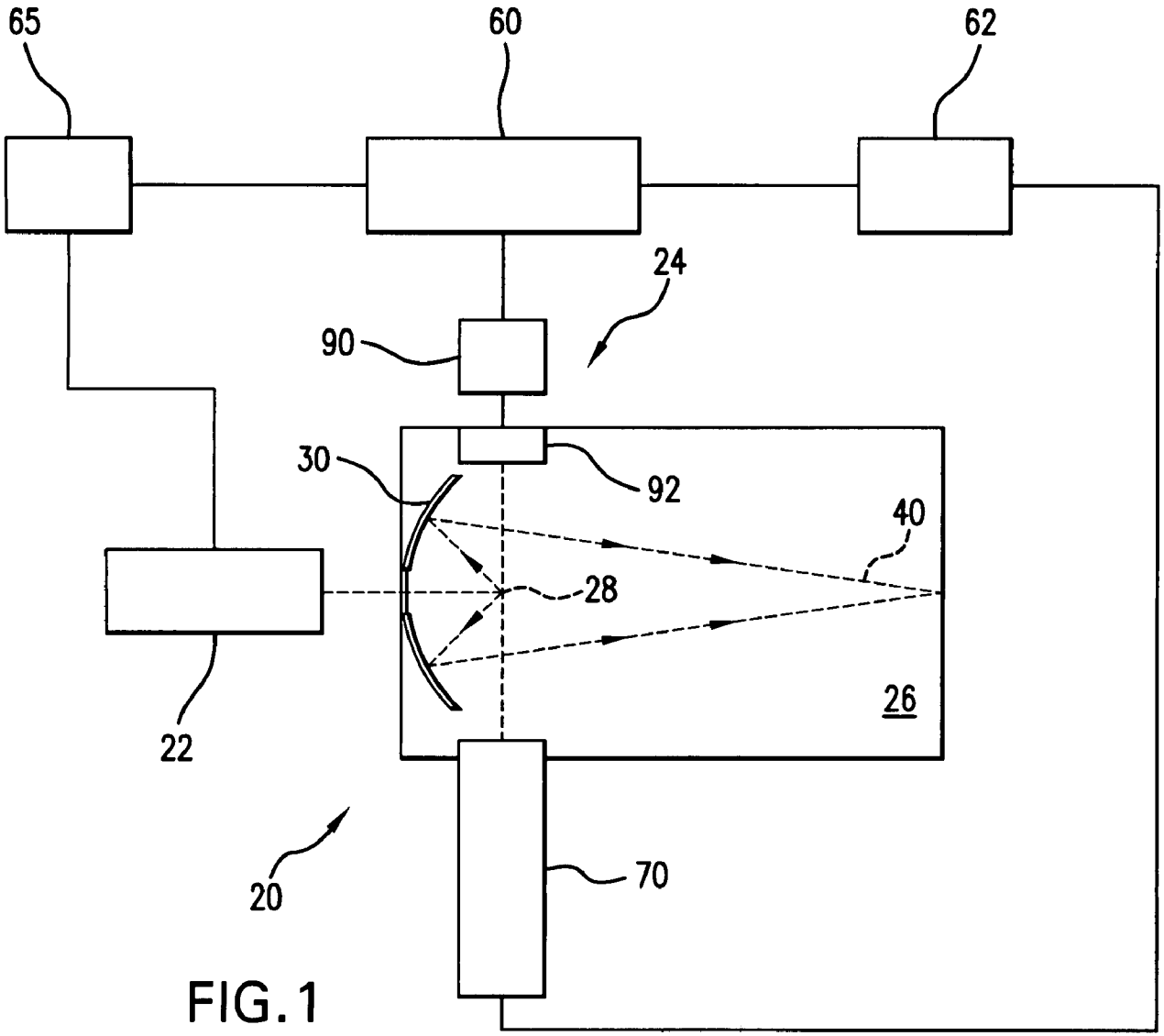
FIG. 1 shows a schematic view of an overall broad conception for a laser-produced plasma EUV light source according to an aspect of the present invention.

With initial reference to FIG. 1 there is shown a schematic view of an exemplary EUV light source, e.g., a laser produced plasma EUV light source 20 according to an aspect of the present invention. As shown, the LPP light source 20 may contain a pulsed or continuous laser system 22, e.g., a pulsed gas discharge $CO_2$, excimer or molecular fluorine laser operating at high power and high pulse repetition rate. Depending on the application, other types of lasers may also be suitable. For example, a solid state laser, a MOPA configured excimer laser system, e.g., as shown in U.S. Pat. Nos. 6,625,191, 6,549,551, and 6,567,450, an excimer laser having a single chamber, an excimer laser having more than two chambers, e.g., an oscillator chamber and two amplifying chambers (with the amplifying chambers in parallel or in series), a master oscillator/power oscillator (MOPO) arrangement, a power oscillator/power amplifier (POPA) arrangement, or a solid state laser that seeds one or more $CO_2$, excimer or molecular fluorine amplifier or oscillator chambers, may be suitable. Other designs are possible.

The light source 20 may also include a target delivery system 24, e.g., delivering targets, e.g. targets of a source material including tin, lithium, xenon or combinations thereof, in the form of liquid droplets, a liquid stream, solid particles or clusters, solid particles contained within liquid droplets or solid particles contained within a liquid stream. The targets may be delivered by the target delivery system 24, e.g., into the interior of a chamber 26 to an irradiation site 28 where the target will be irradiated and produce a plasma. In some cases, the targets may include an electrical charge allowing the targets to be selectively steered toward or away from the irradiation site 28.

Continuing with FIG. 1, the light source 20 may also include a collector 30, e.g., a reflector, e.g., in the form of a truncated ellipse, with an aperture to allow the laser light to pass through and reach the irradiation site 28. The collector 30 may be, e.g., an elliptical mirror that has a first focus at the irradiation site 28 and a second focus at a so-called intermediate point 40 (also called the intermediate focus 40) where the EUV light may be output from the light source 20 and input to, e.g., an integrated circuit lithography tool (not shown).

The light source 20 may also include an EUV light source controller system 60, which may also include a laser firing control system 65, along with, e.g., a laser beam positioning system (not shown). The light source 20 may also include a target position detection system which may include one or more droplet imagers 70 that provide an output indicative of the position of a target droplet, e.g., relative to the irradiation site 28 and provide this output to a target position detection feedback system 62, which can, e.g., compute a target position and trajectory, from which a target error can be computed, e.g. on a droplet by droplet basis or on average. The target error may then be provided as an input to the light source controller 60, which can, e.g., provide a laser position, direction and timing correction signal, e.g., to a laser beam positioning controller (not shown) that the laser beam positioning system can use, e.g., to control the laser timing circuit and/or to control a laser beam position and shaping system (not shown), e.g., to change the location and/or focal power of the laser beam focal spot within the chamber 26.

As shown in FIG. 1, the light source 20 may include a target delivery control system 90, operable in response to a signal (which in some implementations may include the target error described above, or some quantity derived therefrom) from the system controller 60, to e.g., modify the release point of the target droplets as released by the target delivery mechanism 92 to correct for errors in the target droplets arriving at the desired irradiation site 28. Also, as detailed further below, the target error may indicate that the nozzle of the target delivery mechanism 92 is clogged, in which case the target delivery control system 90 may place the target delivery mechanism 92 in a cleaning mode (described below) to unclog the nozzle.

Figure 2:
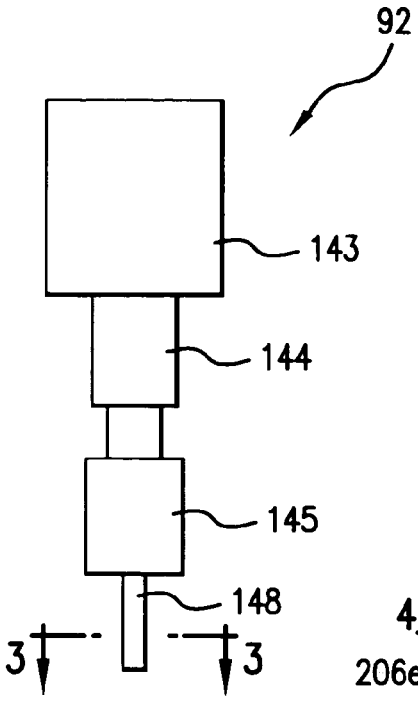
FIG. 2 shows a schematic view of a source material filter/dispenser assembly.

FIG. 2 shows a target delivery mechanism 92 is greater detail. As seen there, the target delivery mechanism 92 may include a cartridge 143 holding a molten source material, e.g. tin, under pressure, e.g. using Argon gas to pass the source material through a set of filters 144, 145 which may be for example, fifteen and seven microns, respectively, which trap solid inclusions, e.g. tin compounds like oxides, nitrides; metal impurities and so on, of seven microns and larger. From the filters 144, 145, the source material may pass to a dispenser 148.

Figure 3:
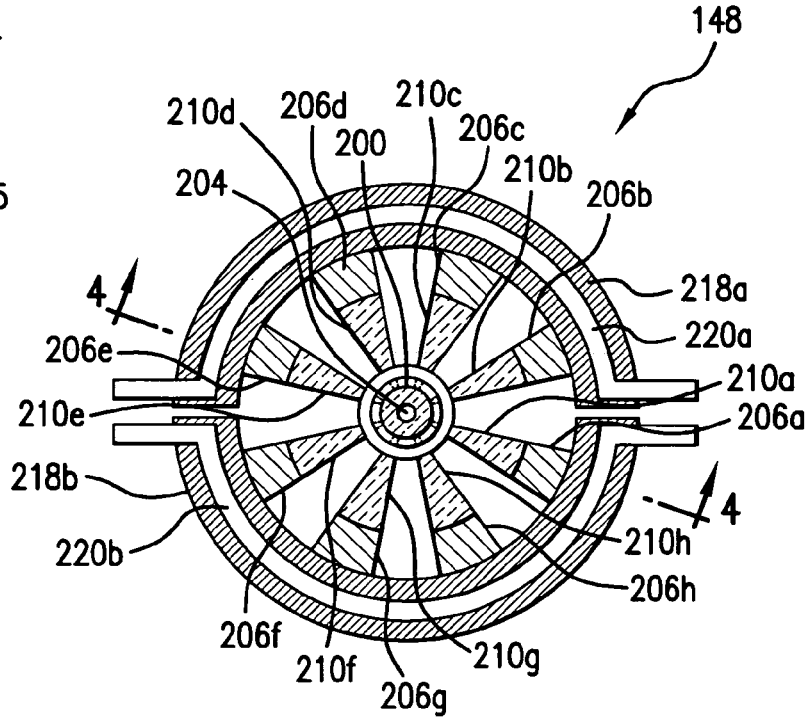
FIG. 3 shows a sectional view of a source material dispenser as seen along line 3-3 in FIG. 2.
Figure 4:
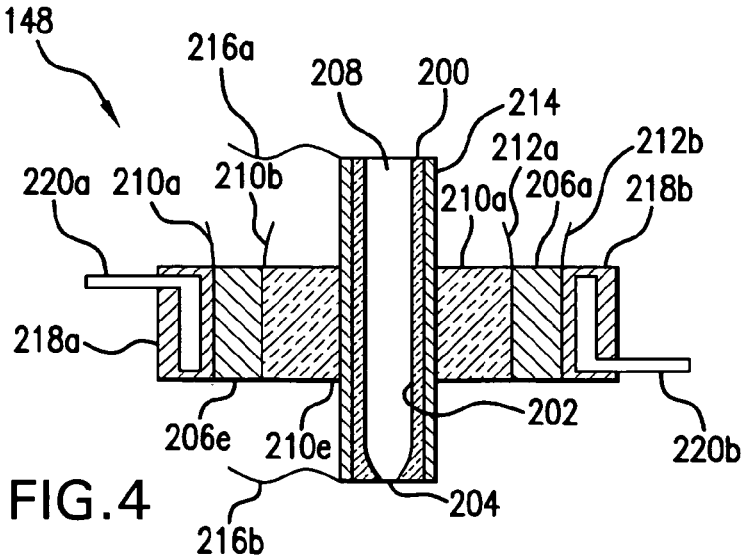
FIG. 4 shows a sectional view of a source material dispenser as seen along line 4-4 in FIG. 3.

FIGS. 3 and 4 show a source material dispenser 148 in greater detail. As seen there, the dispenser 148 may include a source material reservoir 200, which, as shown, may be a tube, and more particularly, may be a so-called capillary tube. Although a tubular reservoir is shown, it is to be appreciated that other configurations may be suitable. For the dispenser 148, the reservoir 200 may be made of glass, may include a wall 202 and be formed with an orifice 204. For example, the orifice 204 may constitute a nozzle diameter of about 30 microns. As best seen in FIG. 3, the dispenser 148 may include a plurality of electro-actuatable elements 206*a-h*, that for the embodiment shown, are each spaced from the wall 202 of the reservoir 200. As further shown, each individual element 206*a-h* may be positioned to deform a different portion of the wall 202 to modulate a release of source material 208 from the dispenser. Although eight elements 206*a-h* are shown, it is to be appreciated that more than eight and as few as one element may be used in certain embodiments of the dispenser 148. In addition, although the elements 206*a-h* shown are shaped as segments of an annular ring and made of a piezoelectric material, other shapes may be suitable, and other types of electro-actuatable elements may be used depending on the application. FIG. 4 illustrates that a separate pair of control wires is provided for each element 206 to allow each element 206 to be selectively expanded or contracted by the controller 90 (see FIG. 1) either independently, or in cooperative association with one or more other elements 206. More specifically, as shown, wire pair 210*a,b* is provided to supply an AC or pulsed driving voltage to electro-actuatable element 206*e* and wire pair 212*a,b* is provided to supply an AC driving voltage to electro-actuatable element 206*a*.

Continuing now with reference to FIG. 3, is can be seen that the dispenser 148 may include heat insulators 210*a-h*, with each insulator 210 disposed between a respective electro-actuatable element 206 and the wall 202 of the reservoir 200. For the embodiment shown, the heat insulators 210*a-h* may be pie-shaped, may be made of a rigid material, and may perform both mechanical contact and heat isolation functions between the wall 202 of the reservoir 200 and the electro-actuatable elements 206. In a typical arrangement, the insulators 210*a-h* may be fabricated of silica or some other suitable material which has a relatively low thermal expansion coefficient and relatively low thermal conductivity.

FIGS. 3 and 4 also show that the dispenser 148 may include a heat source 214 for maintaining the source material 208 within a preselected temperature range while the source material 208 is in the reservoir 200. For example, the source material 208 may consist of molten tin and may be maintained by the heat source at a temperature in the range of 300-400 degrees Celsius. In one implementation, the heat source 214 may include a resistive material such as molybdenum that is applied as a coating on the wall 202 of the reservoir 200. The coating may be, for example, a few microns of Mo film deposited on the glass reservoir 200. In particular, Mo has a good matching of thermal expansion coefficient to that of glass.

An electrical current may then be selectively passed through the resistive material via wires 216*a,b* to supply heat to the source material 208. With this arrangement, the insulators 210*a-h* are positioned to reduce the flow of heat from the heat source 214 to the electro-actuatable element.

As best seen in FIG. 3, the dispenser 148 may include a two-piece circular clamp assembly 218*a,b* to clamp the electro-actuatable elements 206 and insulators 210 on the reservoir 200 and obtain a relatively good mechanical contact between the electro-actuatable elements 206 and the reservoir 200. For the arrangement shown, a cooling system which includes cooling channels 220*a,b* formed in the clamp assembly 218*a,b* may be provided. The electro-actuatable elements 206 may be bonded to the clamp assembly 218 with standard adhesive since in a typical embodiment, the joint may operate at room temperature. With the above described arrangement, a source material 208 such as tin may be maintained by the heat source 214 at a temperature in the range of about 300-400 degrees Celsius while the electro-actuatable elements 206 are maintained at about 100 degrees Celsius or lower, well below the operation range of many piezoelectric materials.

OPERATION

As previously indicated, a separate pair of control wires may be provided for each element 206 to allow the elements 206 to be selectively expanded or contracted by a drive signal either independently, or in cooperative association with one or more other elements 206. As used herein, the term "drive signal" and its derivatives means one or more individual signals which may, in turn, include one or more drive control voltages, currents, etc for selectively expanding or contracting one or more electro-actuatable elements. For example, the drive signal may be generated by the controller 90 (see FIG. 1).

With the above described structural arrangement, the dispenser 148 may be operated in one of several different control modes, to include an operational mode in which a first drive signal is utilized to modulate a release of source material from the reservoir for subsequent plasma production, and a cleaning control mode in which a second drive signal, different from the first drive signal is used for unclogging a clogged dispenser orifice. For example, an operational mode may be implemented using a drive signal in which a sine wave of the same phase is applied to all electro-actuatable elements 206. Thus, in this particular implementation, all electro-actuatable elements 206 may be compressed and expanded simultaneously.

Figure 5:
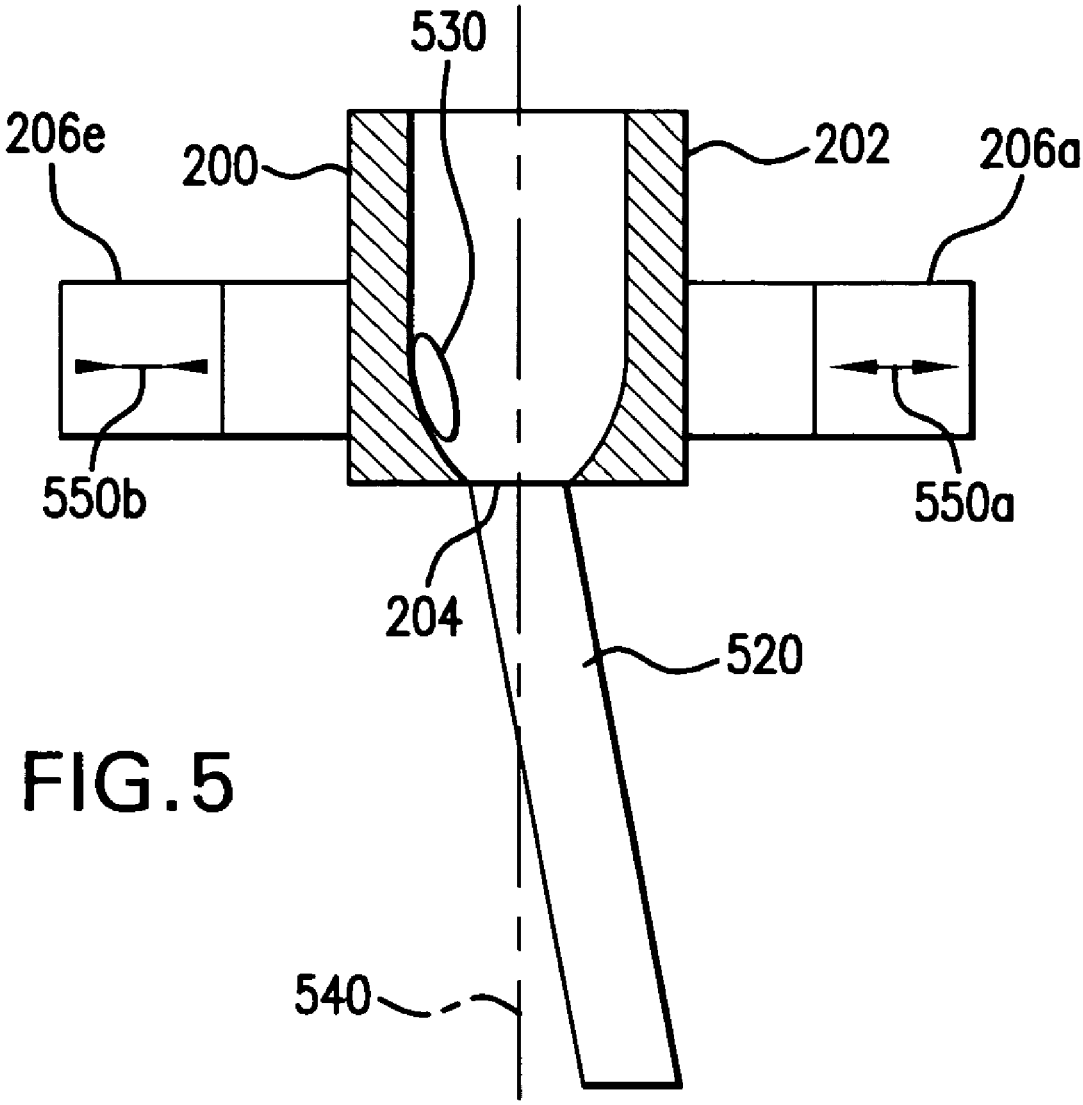
FIG. 5 shows a portion of a source material dispenser to illustrate a control mode in which a clogged nozzle orifice may be unclogged.

A better understanding of an implementation of a cleaning control mode may be obtained with reference now to FIG. 5. As shown there, solids 530 such as impurities may stick to the wall 202 of the reservoir 200 near the orifice 204. In some cases, the presence of these solids may affect the flow of source material from the dispenser 148. In particular, as shown in FIG. 5, the solid 530 may cause source material to exit the dispenser 148 along path 520, which is at an angle to the desired path 540. Thus, solids which deposit near the orifice 204 can contribute to, among other things, poor angular stability of the exiting source material, e.g. droplet jet, and thus, significantly reduce the maintenance-free, operational lifetime of a source. material dispenser such as a droplet generator. With the above in mind, the angular stability of the dispenser may be monitored, e.g. using the droplet imager 70 shown in FIG. 1. With this monitoring, an angular stability error signal can be generated and used to change control modes, e.g. from operational mode to cleaning mode and/or from cleaning mode to operational mode. Also, the monitoring may be indicative of the location of solid deposits, allowing for the use of a particular cleaning mode that is specific to the solid deposit location.

In one implementation of a cleaning mode, the phase and shape of driving voltages used to actuate opposed, electro-actuatable element pairs, such as pair 206*a*, 206*e* shown in FIG. 5 may be controlled to selectively move the dispenser tip (i.e. the end near the orifice 204) and shake loose deposited solids. For example, a rectangular pulse voltage may be applied to the electro-actuators 206*a*, 206*e*, simultaneously driving them in the same direction (i.e. electro-actuator 206*a* is expanded (as illustrated by arrow 550*a*) and simultaneously electro-actuator 206*e* is contracted (as illustrated by arrow 550*b*)) and then the driving direction is reversed. For the embodiment shown in FIG. 3, four opposed electro-actuator pairs are provided allowing the shake direction to be varied based on the location of the deposits. As indicated above, monitoring of the source material exit path may be indicative of the location of solid deposits.

In another implementation, a circular motion may be imparted to the dispenser tip to shake deposits loose, for example, by applying a sine wave with phase shift equal to $^{360}/_{2}n$, where n is the number of pairs of electro-actuators. For example, if two electro-actuator pairs are employed, a phase shift of about 90 degrees may be used.

It will be understood by those skilled in the art that the aspects of embodiments of the present invention disclosed above are intended to be preferred embodiments only and not to limit the disclosure of the present invention(s) in any way and particularly not to a specific preferred embodiment alone. Many changes and modification can be made to the disclosed aspects of embodiments of the disclosed invention(s) that will be understood and appreciated by those skilled in the art. The appended claims are intended in scope and meaning to cover not only the disclosed aspects of embodiments of the present invention(s) but also such equivalents and other modifications and changes that would be apparent to those skilled in the art. While the particular aspects of embodiment(s) described and illustrated in this patent application in the detail required to satisfy 35 U.S.C. § 112 are fully capable of attaining any above-described purposes for, problems to be solved by or any other reasons for or objects of the aspects of an embodiment(s) above described, it is to be understood by those skilled in the art that it is the presently described aspects of the described embodiment(s) of the present invention are merely exemplary, illustrative and representative of the subject matter which is broadly contemplated by the present invention. The scope of the presently described and claimed aspects of embodiments fully encompasses other embodiments which may now be or may become obvious to those skilled in the art based on the teachings of the Specification. The scope of the present invention is solely and completely limited by only the appended claims and nothing beyond the recitations of the appended claims. Reference to an element in such claims in the singular is not intended to mean nor shall it mean in interpreting such claim element "one and only one" unless explicitly so stated, but rather "one or more". All structural and functional equivalents to any of the elements of the above-described aspects of an embodiment(s) that are known or later come to be known to those of ordinary skill in the art are expressly incorporated herein by reference and are intended to be encompassed by the present claims. Any term used in the specification and/or in the claims and expressly given a meaning in the Specification and/or claims in the present application shall have that meaning, regardless of any dictionary or other commonly used meaning for such a term. It is not intended or necessary for a device or method discussed in the Specification as any aspect of an embodiment to address each and every problem sought to be solved by the aspects of embodiments disclosed in this application, for it to be encompassed by the present claims. No element, component, or method step in the present disclosure is intended to be dedicated to the public regardless of whether the element, component, or method step is explicitly recited in the claims. No claim element in the appended claims is to be construed under the provisions of 35 U.S.C. § 112, sixth paragraph, unless the element is expressly recited using the phrase "means for" or, in the case of a method claim, the element is recited as a "step" instead of an "act".

We claim:

1. A source material dispenser for an EUV light source, said dispenser comprising:

a source material reservoir having a wall and formed with an orifice;

an electro-actuatable element spaced from said wall and operable to deform said wall and modulate a release of source material from said dispenser;

a heat source heating a source material in said reservoir; and an insulator reducing the flow of heat from said heat source to said electro-actuatable element.

2. A dispenser as recited in claim 1 wherein said reservoir comprises a tube.

3. A dispenser as recited in claim 1 wherein said electro-actuatable element is selected from a group of elements consisting of a piezoelectric material, an electrostrictive material and a magnetostrictive material.

4. A dispenser as recited in claim 1 wherein said insulator is disposed between said electro-actuatable element and said wall to transmit forces therebetween.

5. A dispenser as recited in claim 4 wherein said heat source comprises a resistive material and said resistive material is interposed between said wall and said insulator.

6. A dispenser as recited in claim 1 wherein said heat source comprises a resistive material coated on said wall.

7. A dispenser as recited in claim 1 wherein said reservoir wall is made of glass, said heat source comprises a resistive material coating comprising Mo, and said insulator comprises silica.

8. A dispenser as recited in claim 1 wherein said source material comprises liquid Sn.

9. A dispenser as recited in claim 1 further comprising a cooling system for cooling said electro-actuatable element.

10. A source material dispenser for an EUV light source said dispenser comprising:

a source material reservoir having a wall and formed with an orifice;

a plurality of electro-actuatable elements, each element positioned to deform a different portion of said wail and modulate a release of source material from said dispenser.

11. A dispenser as recited in claim 10 further comprising a plurality of insulators, each insulator disposed between a respective said electro-actuatable element and said wall to transmit forces therebetween.

12. A dispenser as recited in claim 11 further comprising a heat source, said heat source comprising a resistive material interposed between said wall and at least one said insulator.

13. A dispenser us recited in claim 10 further comprising a controller for generating a first signal to actuate said electro-actuatable elements to release source material from said reservoir and a second signal, different from said first signal, for unclogging said orifice.

14. A dispenser as recited in claim 10 further comprising a heat source, said heat source comprising a resistive material coated on said wall.

15. A dispenser as recited in claim 10 wherein said source material comprises liquid Sn.

16. A dispenser as recited in claim 10 further comprising a clamp to clamp said electro-actuatable elements on said reservoir.

17. A method of dispensing a source material for an EUV light source said method comprising the acts of:

providing a source material reservoir having a wall and formed with an orifice;

providing a plurality of electro-actuatable elements, each element positioned to deform a different portion of said wall; and actuating said elements to modulate a release of source material from said reservoir.

18. A method as recited in claim 17 further comprising the act of providing a plurality of insulators, each insulator disposed between a respective said electro-actuatable element and said wall to transmit forces therebetween.

19. A method as recited in claim 18 further comprising the act of providing a heat source, said heat source comprising a resistive material interposed between said wall and at least one said insulator.

20. A method as recited in claim 17 wherein a first drive signal is provided to actuate said electro-actuatable elements to modulate a release of source material from said reservoir and a second drive signal, different from said first drive signal, is provided to actuate said electro-actuatable elements and unclog said orifice.

* * * * *